US011324980B2

(12) United States Patent
Koiwa

(10) Patent No.: US 11,324,980 B2
(45) Date of Patent: May 10, 2022

(54) SPRINKLER HEAD

(71) Applicant: SENJU SPRINKLER CO., LTD., Tokyo (JP)

(72) Inventor: Yasuaki Koiwa, Tokyo (JP)

(73) Assignee: SENJU SPRINKLER CO., LTD., Tokyo (JP)

( * ) Notice: Subject to any disclaimer, the term of this patent is extended or adjusted under 35 U.S.C. 154(b) by 0 days.

(21) Appl. No.: 16/963,359

(22) PCT Filed: Nov. 7, 2018

(86) PCT No.: PCT/JP2018/041264
§ 371 (c)(1),
(2) Date: Jul. 20, 2020

(87) PCT Pub. No.: WO2019/150687
PCT Pub. Date: Aug. 8, 2019

(65) Prior Publication Data

US 2020/0360750 A1 Nov. 19, 2020

(30) Foreign Application Priority Data

Feb. 5, 2018 (JP) ..... JP2018-017845

(51) Int. Cl.
*A62C 37/12* (2006.01)

(52) U.S. Cl.
CPC ..... *A62C 37/12* (2013.01)

(58) Field of Classification Search
CPC ..... A62C 37/11; A62C 37/12; A62C 37/14
USPC ..... 169/37, 38
See application file for complete search history.

(56) References Cited

U.S. PATENT DOCUMENTS 777,783 A * 12/1904 Garrett ..... A62C 37/12 169/39
4,108,247 A * 8/1978 Mohler ..... A62C 37/14 169/38
4,167,974 A * 9/1979 Job ..... A62C 37/14 169/38

(Continued)

FOREIGN PATENT DOCUMENTS

JP 52-109798 A 9/1977
JP 61-151750 U 9/1986

(Continued)

OTHER PUBLICATIONS

International Search Report for PCT Patent App. No. PCT/JP2018/041264 (dated Dec. 25, 2018).

*Primary Examiner* — Joseph A Greenlund
(74) *Attorney, Agent, or Firm* — Cermak Nakajima & McGowan LLP; Tomoko Nakajima

(57) ABSTRACT

A sprinkler head includes a body having a nozzle to be connected to a water supply pipe, the nozzle being provided inside the body; a valve that closes the nozzle in normal times; a pair of frames extending from the body in a direction of water discharge from the nozzle; a deflector provided at a distal end of a part where distal ends of the frames are coupled to each other on a center axis A of the nozzle; and a heat sensitive disassembling unit provided between the valve and the deflector. A spring that is bent in a W shape has two ends engaged with the pair of frames, and the heat sensitive disassembling unit is fitted in a bent portion provided between the two ends and of the spring.

11 Claims, 8 Drawing Sheets

(56) References Cited

U.S. PATENT DOCUMENTS 4,176,718 A * 12/1979 Vorkapich ..... A62C 37/12 169/37
4,273,195 A * 6/1981 Fischer ..... A62C 37/12 169/42
4,403,661 A * 9/1983 Tokar ..... A62C 37/12 169/37
4,638,866 A * 1/1987 Capasso ..... A62C 37/20 169/38
4,880,063 A * 11/1989 Leininger ..... A62C 37/12 169/37
4,991,656 A * 2/1991 Polan ..... A62C 37/14 169/38
5,392,993 A * 2/1995 Fischer ..... A62C 31/02 239/524
5,494,113 A * 2/1996 Polan ..... A62C 37/16 169/37
5,613,563 A * 3/1997 Johnson ..... A62C 37/12 169/42
5,628,367 A * 5/1997 Truax ..... A62C 37/14 169/37
5,927,890 A * 7/1999 Job ..... A62C 37/14 403/2
6,374,919 B1 * 4/2002 Neill ..... A62C 37/09 169/41
6,446,732 B1 * 9/2002 Polan ..... B05B 1/265 169/57
6,715,561 B2 * 4/2004 Franson ..... A62C 37/14 169/17
7,584,803 B2 * 9/2009 Ballard ..... A62C 31/02 169/41
7,624,812 B2 * 12/2009 Pahila ..... A62C 31/02 239/524
7,819,201 B2 * 10/2010 Pounder ..... B05B 1/265 169/37
8,122,969 B1 * 2/2012 Fischer ..... A62C 31/02 169/37
8,469,112 B1 * 6/2013 Silva, Jr ..... A62C 35/62 169/17
8,789,615 B2 * 7/2014 Franson ..... A62C 37/08 169/41
D895,416 S * 9/2020 Koiwa ..... D8/499
2003/0201341 A1 * 10/2003 Wancho ..... B05B 1/265 239/498
2015/0367156 A1 * 12/2015 Kadoche ..... A62C 37/12 169/16
2016/0008642 A1 * 1/2016 Kadoche ..... A62C 35/62 169/17
2017/0312561 A1 * 11/2017 Polan ..... A62C 31/28
2020/0360750 A1 * 11/2020 Koiwa ..... A62C 37/12
2020/0406080 A1 * 12/2020 Ohkoshi ..... B05B 1/26
2021/0094051 A1 * 4/2021 Koiwa ..... B05B 1/265

FOREIGN PATENT DOCUMENTS

JP 4-32759 U 3/1992
JP 2006-346497 A 12/2006
WO WO2013/105241 A1 7/2013
WO WO2016/030956 A1 3/2016

* cited by examiner

SPRINKLER HEAD

This application is a national phase entry under 35 U.S.C. § 371 of PCT Patent Application No. PCT/JP2018/041264, filed on Nov. 7, 2018, which claims priority under 35 U.S.C. § 119 to Japanese Patent Application No. 2018-017845, filed Feb. 5, 2018, both of which are incorporated by reference.

TECHNICAL FIELD

The present invention relates to a fire-extinguishing sprinkler head.

BACKGROUND ART

Sprinkler systems are installed in buildings. Such a sprinkler system is automatically activated at the sensing of the heat of fire and sprinkles water to extinguish the fire. A sprinkler head includes a nozzle thereinside. The nozzle is connected to a pipe connected to a water supply source. In normal times, the nozzle is closed. If a fire occurs and the sprinkler head is activated with the heat, the nozzle is opened, whereby water stored in the pipe is discharged from the nozzle. The sprinkler head includes a deflector provided on an extension of the outlet of the nozzle. The deflector scatters water in all directions. When water collides with the deflector, the water is sprinkled over a predetermined range, whereby the fire is suppressed and extinguished.

One example of the sprinkler head configured as above is a frame-type sprinkler head. The frame-type sprinkler head includes a horseshoe-shaped frame having a nozzle inside and extending from a body in the direction of water discharge. The frame is provided with a deflector at a distal end thereof. Water discharged from the nozzle is made to collide with the deflector and is thus scattered in all directions.

A valve that closes the nozzle in normal times is provided between the nozzle and the deflector. The valve is supported by a heat-reactive unit. A widely known heat-reactive unit is a glass bulb or a device using a low-melting-point alloy. When the heat-reactive unit is activated by the heat of a fire, a phenomenon (lodgement) may rarely occur in which the flow of water generated by the nozzle causes any of components forming the heat-reactive unit or the valve to be caught by the deflector.

To prevent the occurrence of lodgement, another sprinkler head includes a spring that urges the valve toward a side deviated from the direction of water flow (see PTL 1, for example).

CITATION LIST

Patent Literature

PTL 1: Japanese Unexamined Patent Application Publication No. 2006-346497

SUMMARY OF INVENTION

Technical Problem

In the above sprinkler head including the spring, two ends of the spring, which has a V shape, are anchored to respective frames, and a bent portion in the middle is anchored to a peripheral wall of the valve. When the heat-reactive unit is activated and the valve is opened, the spring causes the valve to move in a direction deviating from the direction of water discharge from the nozzle and to be thrown to the outside.

The above spring is fitted to the sprinkler head before the heat-sensitive disassembling unit is set in the body. Specifically, the spring is pinched at the two ends and is deformed such that the two ends move toward each other while the valve is held in the middle part of the spring. In this state, the spring and the valve are fitted to the body. However, since the valve is urged by the spring in a direction deviating from the axis of the nozzle, the work of setting the heat-sensitive disassembling unit onto the valve is difficult.

In an alternative case where the spring is fitted after the valve and the heat-sensitive disassembling unit are set in the body, delicate work of passing the ends of the spring through respective gaps between the valve and the frame is necessary. In doing such work, close attention need to be paid so as not to give any impact to the heat-sensitive disassembling unit.

In view of the above problems, an object of the present invention is to provide a sprinkler head configured such that the occurrence of lodgement at the activation of the sprinkler head can be prevented and that is easy to assemble.

Solution to Problem

To achieve the above object, the present invention provides the following sprinkler head.

Specifically, a sprinkler head includes:

a body having a nozzle to be connected to a water supply pipe, the nozzle being provided inside the body;

a valve that closes the nozzle in normal times;

a pair of frames extending from the body in a direction of water discharge from the nozzle;

a deflector provided at a distal end of a part where distal ends of the frames are coupled to each other on a center axis of the nozzle; and a heat-sensitive disassembling unit provided between the valve and the deflector, wherein a spring that is bent in a W shape has two ends engaged with the pair of frames, and the heat-sensitive disassembling unit is fitted in a bent portion provided between the two ends.

The heat-sensitive disassembling unit is fitted in the bent portion of the spring. Therefore, when the nozzle is opened, the spring and the heat-sensitive disassembling unit fitted in the bent portion of the spring move in a direction of urging by the spring, deviating from the axis of the nozzle. Therefore, the heat-sensitive disassembling unit moved by the flow of water discharged from the nozzle can be prevented from being caught by the deflector.

If a link formed of a plurality of thin plates joined to one another with a low-melting-point alloy is employed as an example of the heat-sensitive disassembling unit, the heat-sensitive disassembling unit may further include a bar and a lever that are engaged with the link. To fit the bar as one of the components forming the heat-sensitive disassembling unit into the bent portion of the spring, the spring is deformed by applying forces to the two respective ends thereof such that the two ends move toward each other. Accordingly, the gap at an open part of the bent portion is widened, allowing the bar to be fitted into the bent portion. When the forces applied to the two ends of the spring are removed, the spring restores its original shape and the gap at the open part of the bent portion is reduced, whereby the bar is retained in the bent portion.

To set the spring in the sprinkler head, the valve and the heat-sensitive disassembling unit are first set in the body. Subsequently, the bent portion of the W-shaped spring is brought toward the bar in a direction perpendicular to the center axis of the nozzle. Then, the two ends of the spring come into contact with the pair of frames, respectively. As the spring is further brought closer to the bar, the two ends of the spring interfere with the pair of frames and are displaced toward each other. As a result of the displacements, the gap at the open part of the bent portion is widened. Hence, the bar is fitted into the bent portion. When the spring is released in this state, the two ends of the spring are engaged with the pair of frames, respectively, with the bar being fitted in the bent portion.

The heat-sensitive disassembling unit may be a glass bulb. In such a case, for example, a valve having a bottomed cylindrical shape is employed. A bottom side of the valve is positioned in the nozzle, and one end of the heat-sensitive disassembling unit is made to engage with the open side of the valve. Thus, the open side of the valve can be fitted in the bent portion of the spring.

Advantageous Effects of Invention

As described above, the present invention realizes a sprinkler head configured such that the occurrence of lodgement at the activation of the sprinkler head can be prevented and that is easy to assemble.

DESCRIPTION OF EMBODIMENTS

Figure 1:
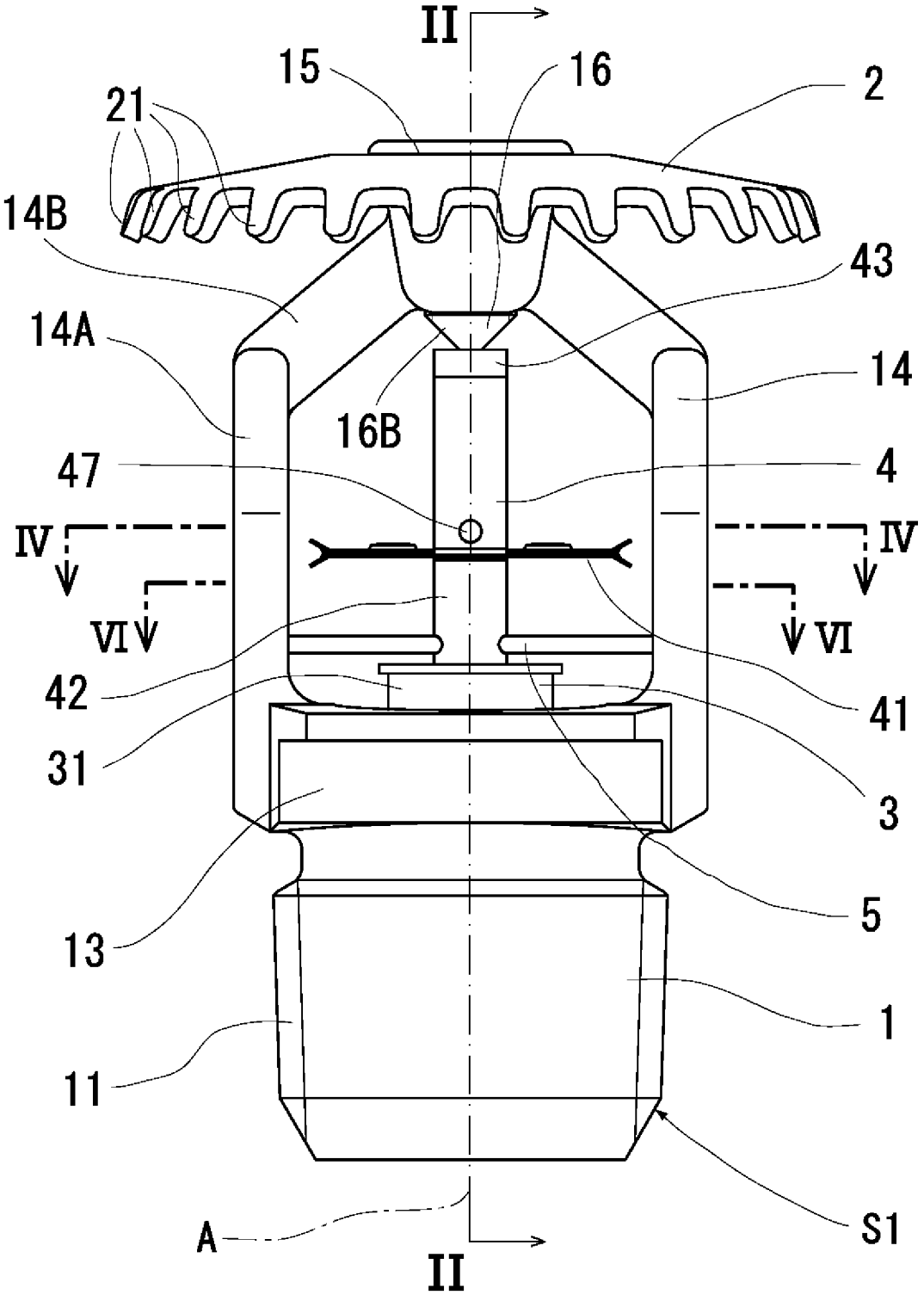
FIG. 1 is a front view of a sprinkler head according to the present invention.
Figure 2:
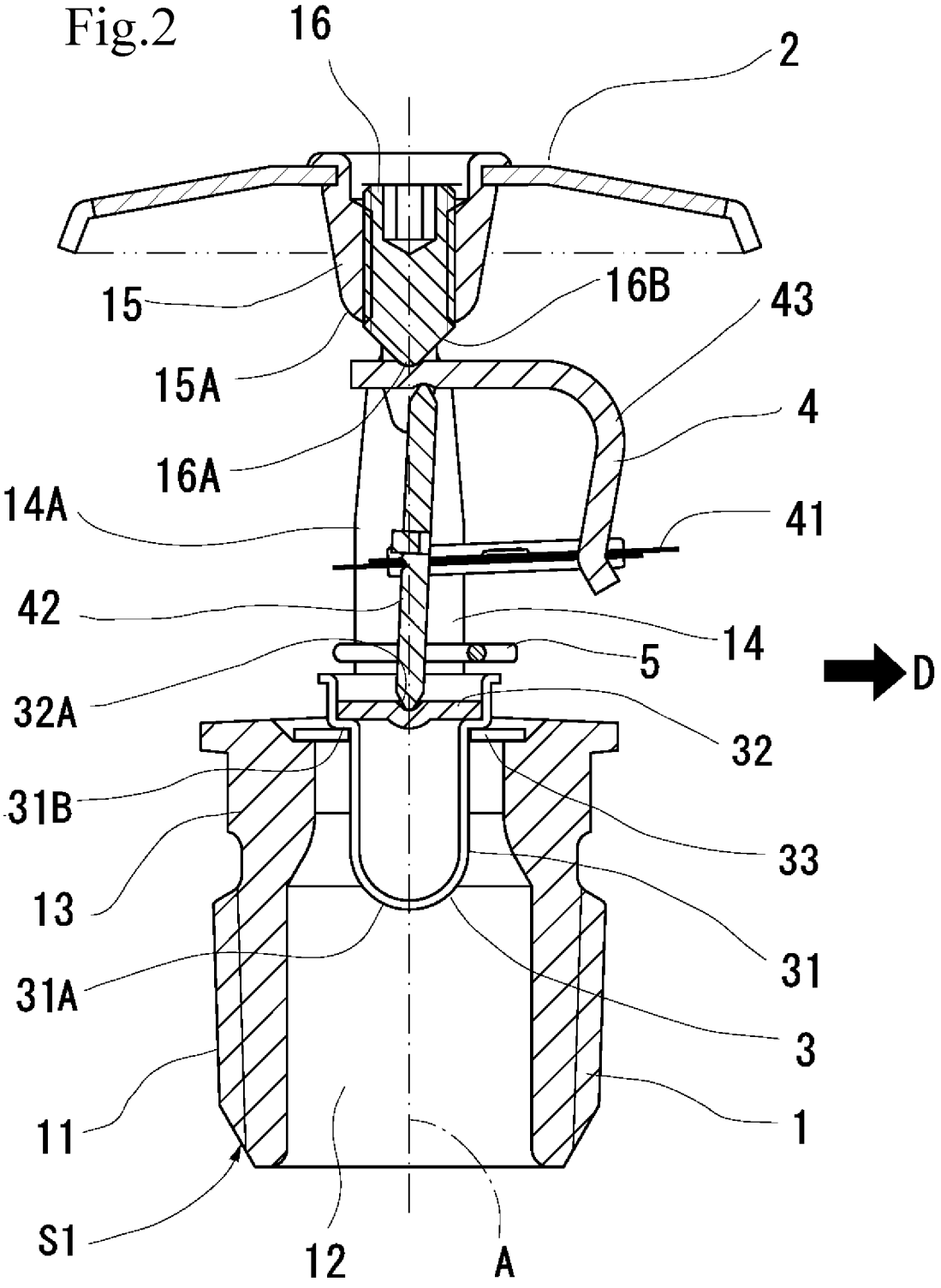
FIG. 2 is a sectional view taken along line II-II illustrated in FIG. 1.

A sprinkler head S1 according to the present invention illustrated in FIGS. 1 and 2 includes a body 1, a deflector 2, a valve 3, a heat-sensitive disassembling unit 4, and a spring 5.

The body 1 has a hollow shape, with an external thread 11 carved on the outside thereof and a nozzle 12 formed on the inside thereof. The external thread 11 is provided for connection to a pipe provided near the ceiling of a building. The size of the nozzle 12 is defined within a range of a K factor of 3 to 5.8. The K factor is obtained from the flow rate and the discharge pressure of the nozzle 12. The K factor in the present embodiment is 5.6. The size of the external thread 11, which is connected to the pipe, is NPT ½ or R ½.

Figure 3:
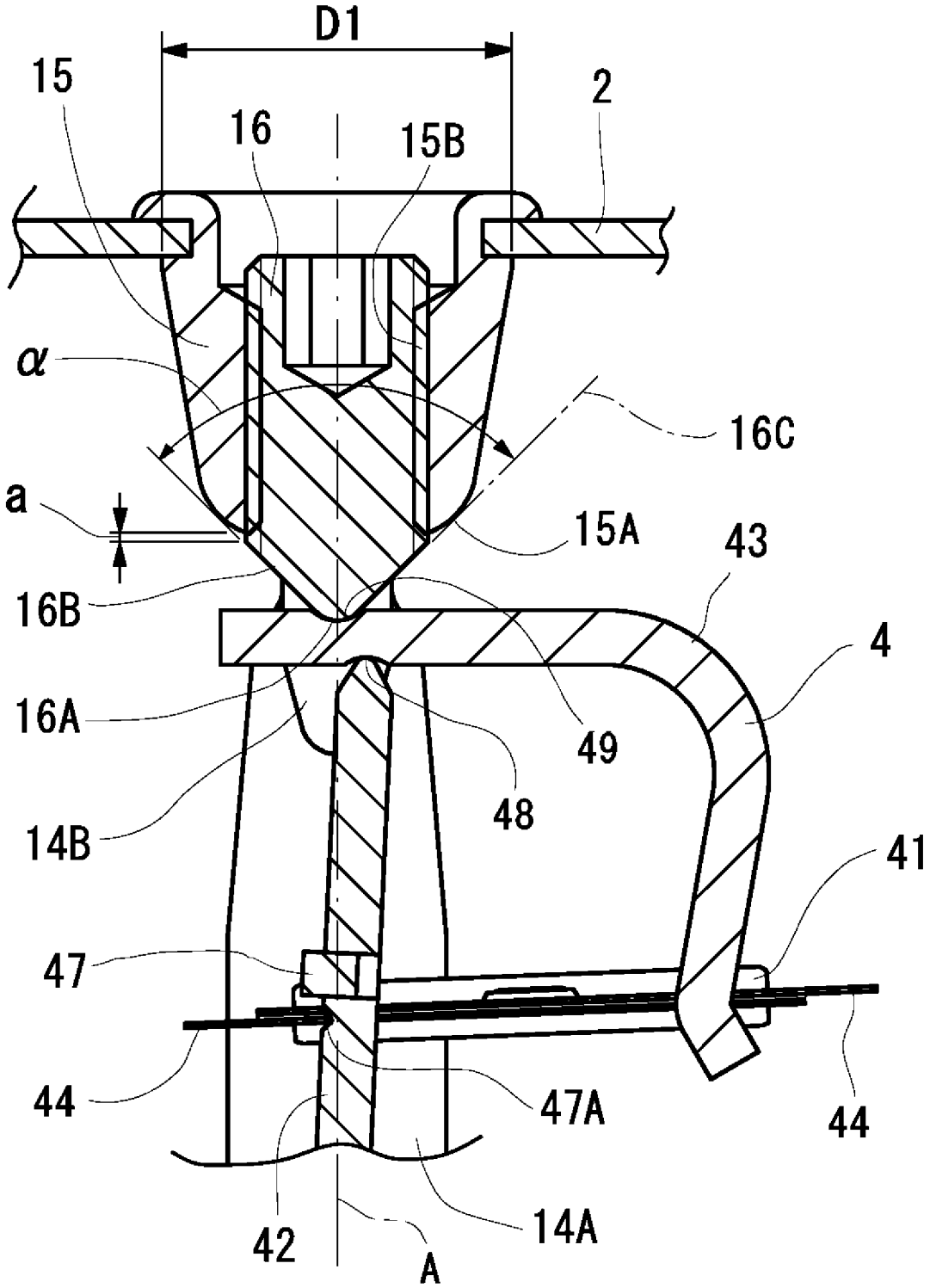
FIG. 3 is an enlarged sectional view of a heat-sensitive disassembling unit illustrated in FIG. 2.

A substantially rectangular base 13 is provided near the outlet of the nozzle 12. A pair of frames 14 extend from the base 13 in a direction of water discharge from the nozzle 12. The frames 14 each include a linear portion 14A extending substantially parallel to a center axis A of the nozzle, and an intersecting portion 14B extending from an end of the linear portion 14A and coupled to a boss 15 provided on the center axis A of the nozzle 12. As illustrated in FIG. 3, the intersecting portion 14B is narrower than the linear portion 14A and has an elliptical sectional shape.

The boss 15 has a tapered round columnar shape. The deflector 2 is provided at an end of the boss 15. A diameter Dl of the boss 15 on a side where the boss 15 is in contact with the deflector 2 is 9 to 10 mm. The outside diameter of the boss 15 at an end on a side nearer to the nozzle 12 is smaller than the diameter Dl on the side nearer to the deflector 2. An outer peripheral end 15A of the boss 15 on the side nearer to the nozzle 12 has a curved surface with a radius of curvature of 1 mm to 3 mm. In the present embodiment, the radius of curvature is 2 mm.

The boss 15 has an internal thread 15B carved on the inside thereof. An impression screw 16 is screwed into the boss 15. The impression screw 16 has a pointed tip 16A with an inclined surface 16B. The tip 16A faces toward the nozzle 12. The inclined surface 16B is at an angle $\alpha$ of 80° to 100°. In the present embodiment, the angle $\alpha$ is 90°. The tip 16A has a spherical top with a spherical radius of preferably 2 mm or smaller. In the present embodiment, the spherical radius is 1 mm or smaller.

The impression screw 16 has a function of pressing the valve 3 toward the nozzle 12 with the heat-sensitive disassembling unit 4 in between. In FIG. 3, an extension 16C extended along the inclined surface 16B around the tip 16A of the impression screw 16 is in proximity to or in contact with the curved surface at the outer peripheral end 15A of the boss 15. Therefore, water running along the surface of the tip 16A and being about to pass the outer peripheral end 15A is not hindered from running along the outer peripheral end 15A, whereby the occurrence of turbulent flow is prevented. In the above configuration, an interval a between the inclined surface 16B of the impression screw 16 and an end face of the boss 15 on the side nearer to the nozzle 12 is set to 2 mm or smaller, more preferably 1 mm or smaller. If the interval is greater than the above, the probability of occurrence of turbulent flow increases.

The deflector 2 illustrated in FIG. 1 has a disc shape and has a plurality of teeth 21 at the peripheral edge thereof.

In normal times, the valve 3 covers the outlet of the nozzle 12. The valve 3 includes a valve cap 31, a disc 32, and a disc spring 33. The valve cap 31 has a bottomed cylindrical shape with one end thereof forming a spherical bottom portion 31A. The other end of the valve cap 31 has an increased diameter, forming a step 31B.

The disc 32, which is a circular plate, is placed on the inner peripheral side of the step 31B. The disc 32 has a recess 32A in the center thereof. The recess 32A is engaged with one end of a bar 42 included in the heat-sensitive disassembling unit 3.

The disc spring 33 is anchored on the outer peripheral side of the step 31B by inserting the valve cap 31 into the disc spring 33 from the bottom portion 31A. The surface of the disc spring 33 is coated with fluorocarbon resin. The outer peripheral edge of the disc spring 33 is positioned at the outlet end of the nozzle 12. Screwing the impression screw 16 into the boss 15 along the internal thread 15B causes the heat-sensitive disassembling unit 4 to press the disc spring 33, whereby the disc spring 33 is squashed while undergoing elastic deformation. In this process, the fluorocarbon resin serves as a sealing material and thus seals the nozzle 12.

The heat-sensitive disassembling unit 4 includes a link 41, the bar 42, and a lever 43. The link 41 is a heat-sensitive body activated with the heat of fire and includes two thin metal plates 44 that are joined to each other with a low-melting-point alloy. The low-melting-point alloy used here has a melting point within a range of 60 to 200° C. In general, a low-melting-point alloy having a melting point of 72° C. or 96° C. is used.

The two metal plates 44 each have a substantially square shape with a hole 45 at one end thereof and a rectangular-U-shaped cut 46 at the other end thereof. The two metal plates 44 are joined to each other with a low-melting-point alloy. Specifically, the hole 45 of one of the metal plates 44 and the cut 46 of the other metal plate 44 are made to coincide with each other. After the above joining, the bar 42 and the lever 43 are inserted into the two holes 45 of the link 41, respectively (see FIG. 4).

The bar 42 has a strip-like shape with one end being engaged with the disc 32 of the valve 3 at the outlet of the nozzle 12, and the other end being engaged with an end of the lever 43. As described above, the bar 42 extends through the hole 45 of the link 41. The bar 42 has a projection 47 in a middle part thereof. The link 41 is anchored in a groove 47A provided near the projection 47.

The lever 43 is a long narrow plate that is bent in a substantially L shape. As described above, the one end of the lever 43 extends through the hole 45 of the link 41. The other end of the lever 43 is engaged with the bar 42. The lever 43 has a groove 48 with which an end of the bar 42 is engaged.

The lever 43 has a recess 49 on a side thereof opposite the side having the groove 48. The recess 49 is positioned nearer to the other end of the lever 43 than the groove 48. The impression screw 16 is in contact with the recess 49. When the tip of the impression screw 16 is pressed into the recess 49 of the lever 43, a force acts on the lever 43 to rotate the lever 43 about the groove 48, in which the bar 42 is anchored. However, since the one end of the lever 43 extends through the hole 45 of the link 41, the lever 43 is prevented from rotating. Hence, the link 41, the bar 42, and the lever 43 forming the heat-sensitive disassembling unit 4 are kept engaged with one another. Furthermore, the impression screw 16 keeps pressing the valve 3 toward the nozzle 12 with the heat-sensitive disassembling unit 4 in between.

Figure 5:
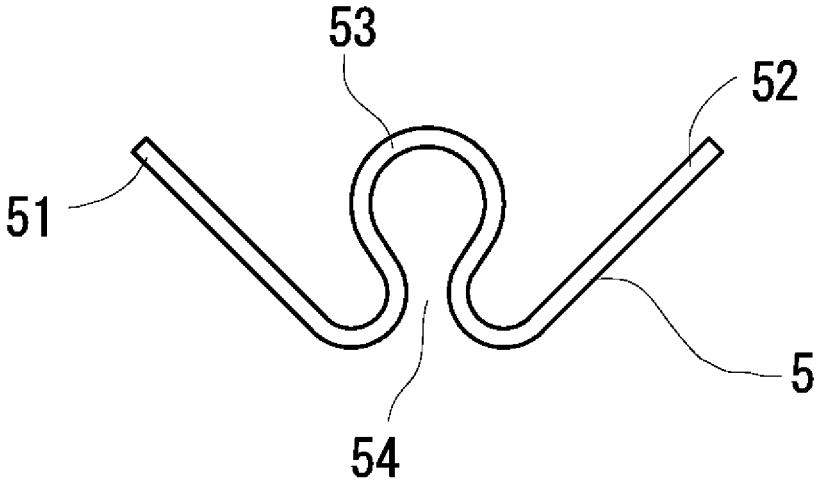
FIG. 5 is a front view of a spring.
Figure 6A:
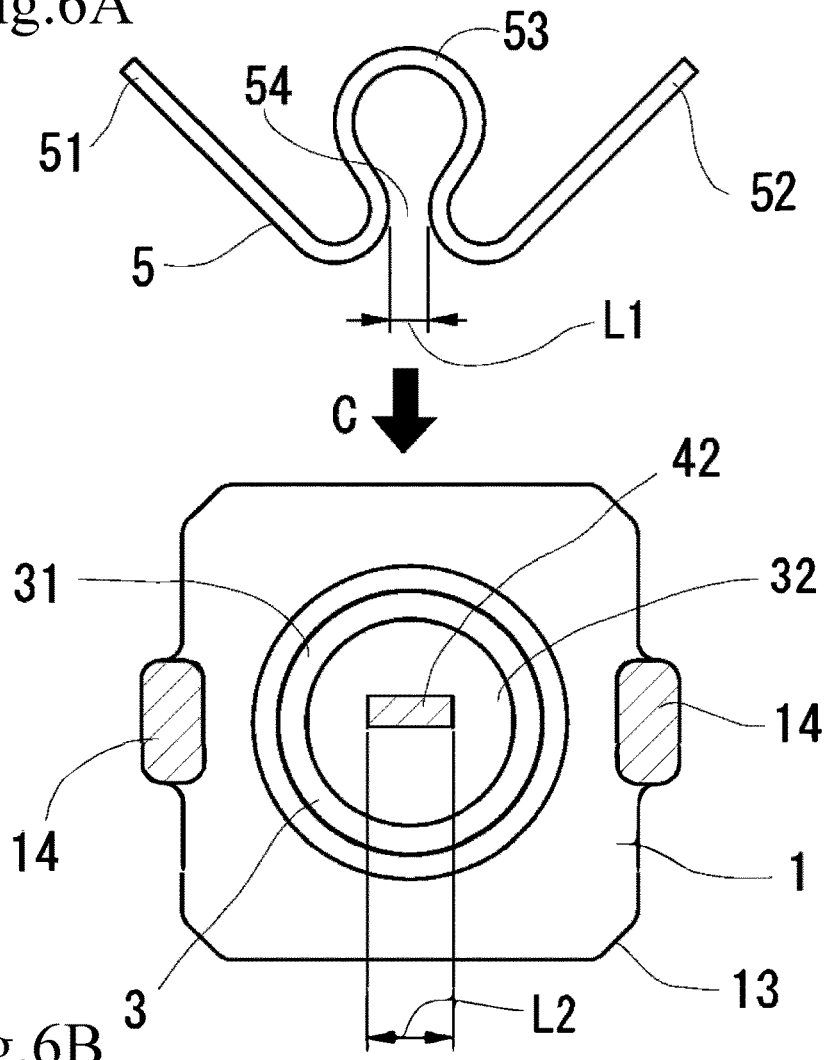
FIG. 6 includes sectional views taken along line VI-VI illustrated in FIG. 1, with (a) illustrating a state before the spring is fitted and (b) illustrating a state after the spring is fitted.
Figure 6B:
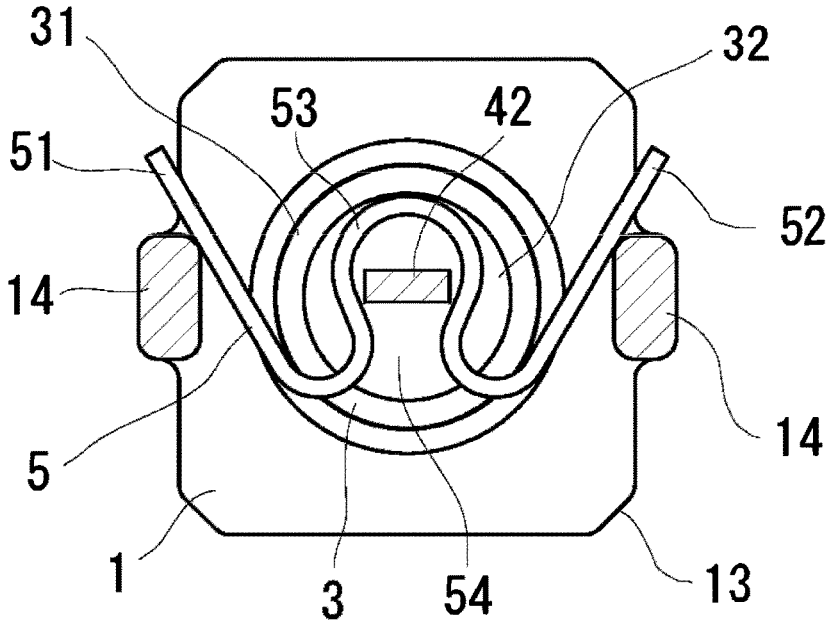

The spring 5 illustrated in FIG. 5 is made of a piece of wire intended for springs and has a substantially W shape. As illustrated in FIG. 6(*b*), two ends 51 and 52 of the spring 5 are anchored to the respective frames 14. A bent portion 53 provided between the ends 51 and 52 of the spring 5 is bent in an arc shape and thus has a C shape. The bar 42 is fitted in the bent portion 53.

The spring 5 illustrated in FIG. 6(*a*) is yet to be anchored to the frames 14. In this state, a gap L1 at an open part 54 of the bent portion 53 is narrower than a width L2 of the bar 42. Therefore, the bar 42 cannot be fitted into the bent portion 53. To anchor the spring 5 to the frames 14, forces are applied to the respective ends 51 and 52 in such a manner as to move the ends 51 and 52 toward each other. Thus, the spring 5 elastically deforms, and the gap L1 at the open part 54 is widened. When the forces applied to the ends 51 and 52 are removed with the bar 42 being positioned in the bent portion 53, the bar 42 is retained in the bent portion 53. Thus, the ends 51 and 52 are anchored to the respective frames 14 (see FIG. 6(*b*)).

Figure 4:
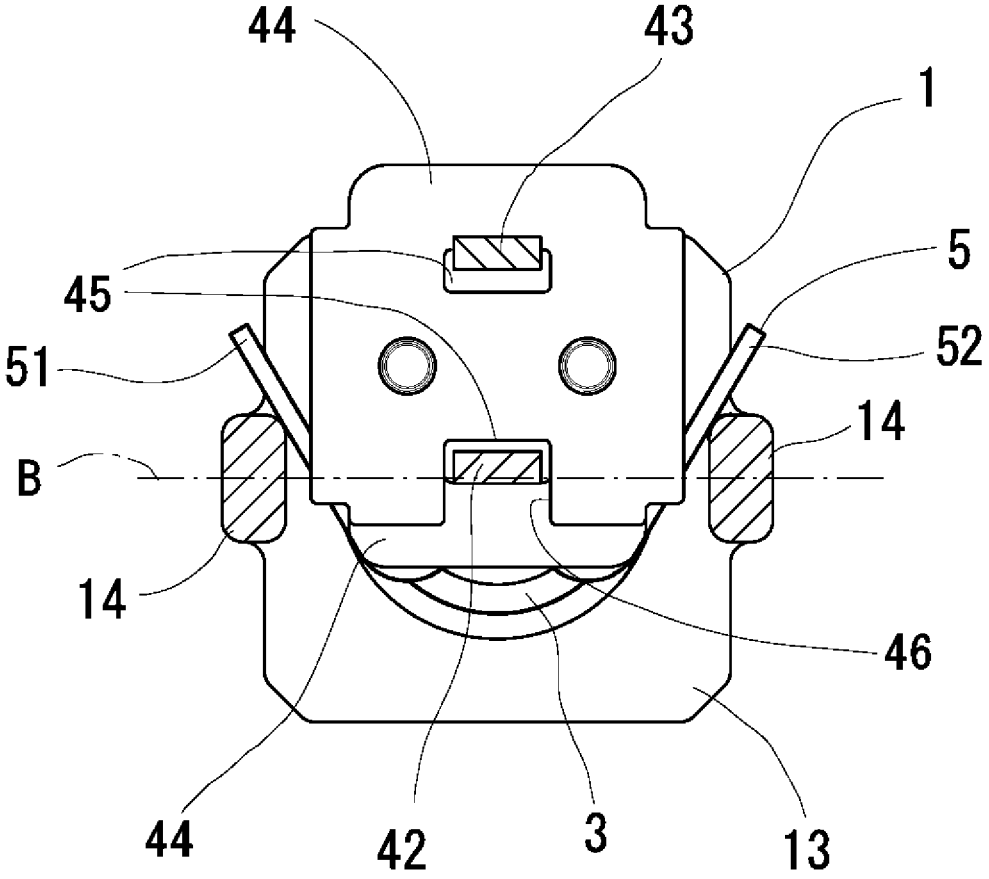
FIG. 4 is a sectional view taken along line IV-IV illustrated in FIG. 1.

Referring to FIG. 4, the ends 51 and 52 of the spring 5 are engaged with the outer peripheries of the respective frames 14 on a side nearer to the lever 43 with respect to a line B passing through the center axis A of the nozzle and through the frames 14. The bar 42 fitted in the bent portion 53 is urged toward the lever 43 by the spring 5. Therefore, when the sprinkler head S1 is activated, the spring 5 and the bar 42 move toward the lever 43.

A process of setting the spring 5 in the sprinkler head S1 will now be described.

First, the valve 3 and the heat-sensitive disassembling unit 4 are set in the body 1 of the sprinkler head S1. Then, the spring 5 is anchored to the frames 14 while the bar 42 is fitted into the bent portion 53. The spring 5 is made to advance between the link 41 and the valve 3 in a direction indicated by arrow C in FIG. 6(*a*) (in a direction perpendicular to the center axis A of the nozzle), with the open part 54 of the spring 5 facing toward the bar 42. Then, the ends 51 and 52 of the spring 5 interfere with the respective frames 14. Therefore, the spring 5 elastically deforms such that the ends 51 and 52 thereof move toward each other. Consequently, the open part 54 of the bent portion 53 is widened.

As the spring 5 is further moved in the direction of arrow C, the bar 42 passes the open part 54 and enters the bent portion 53. When the spring 5 is released in the above state, the two ends 51 and 52 of the spring 5 are anchored to the respective frames 14, whereby the bar is retained in the bent portion 53. Thus, the fitting of the spring 5 to the sprinkler head S1 is complete.

Now, an operation of the sprinkler head S1 in case of fire will be described.

The sprinkler head S1 is set with the deflector 2 being oriented upward. In normal times, the nozzle 12 is connected to a pipe, not illustrated, screwed on the external thread 11. The inside of the nozzle 12 is filled with pressurized water. The nozzle 12 is closed by the valve 3 and the heat-sensitive disassembling unit 4.

If a fire occurs and the low-melting-point alloy of the link 41 melts, the lever 43 rotates, whereby the metal plate 44 engaged with the lever 43 is stripped off the metal plate 44 engaged with the bar 42. Consequently, the engagements in the heat-sensitive disassembling unit 4 are disabled. That is, the link 41, the bar 42, and the lever 43 are disengaged from one another, and the valve 3 that has been supported by the bar 42 drops off the nozzle 12, whereby the nozzle 12 is opened.

In this process, since the spring 5 is anchored to the frames 14 and is urged in a direction indicated by arrow D in FIG. 2, the spring 5 retaining the bar 42 in the bent portion 53 thereof moves in the direction of arrow D, deviating from the direction of the flow of water discharged from the nozzle 12, and is thrown to the outside of the sprinkler head S1.

The embodiment of the present invention is as described above. Now, other configurations and effects thereof will be described.

While the above embodiment concerns a case where the part of the lever 43 that is engaged with the impression screw 16 is shaped as the recess 49, the part is not limited thereto and may be shaped as a projection. In that case, the tip of the impression screw 16 may be modified to be shaped as a recess or a groove conforming to the shape of the projection.

Figure 7:
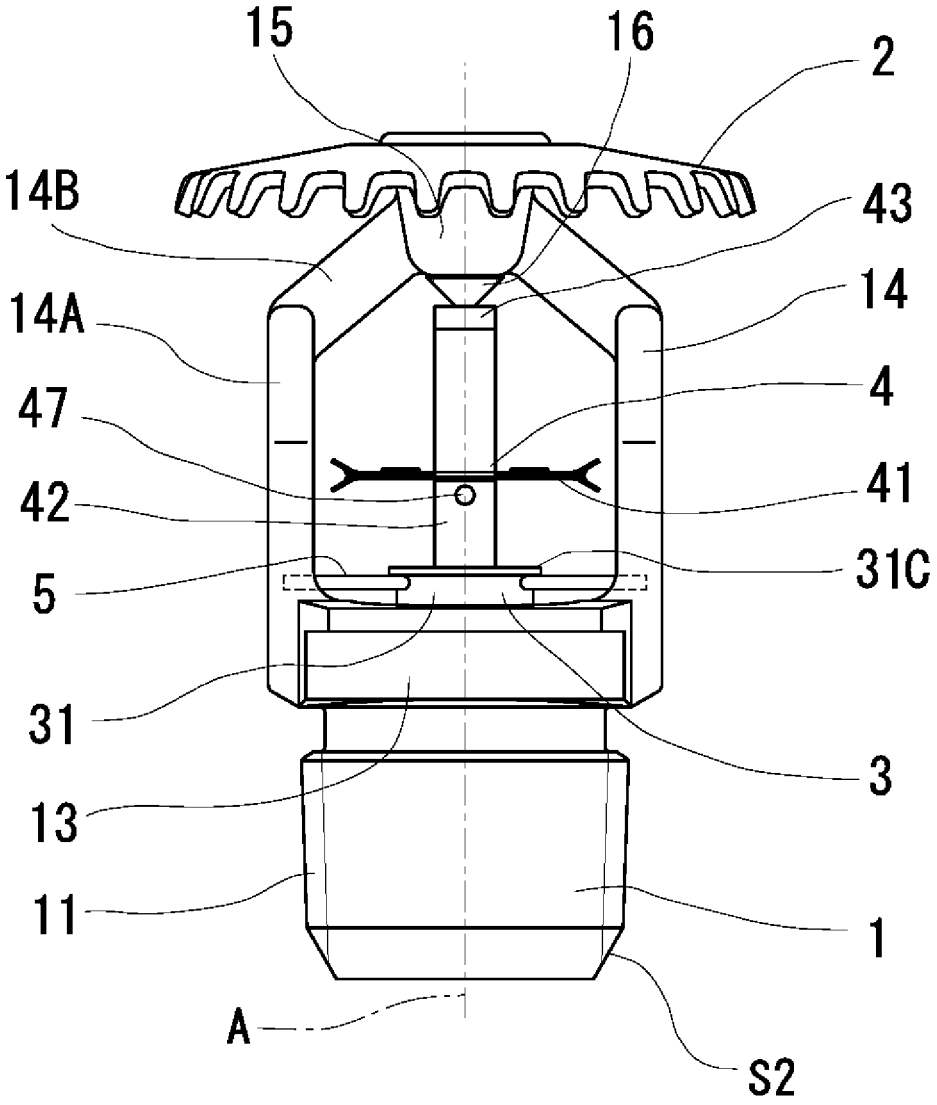
FIG. 7 is a front view of the sprinkler head with a modified spring.

As in a sprinkler head S2 illustrated in FIG. 7, a modification of the spring 5 may be configured such that the valve cap 31 is fitted in the bent portion 53 of the spring 5. More specifically, the bent portion 53 may be fitted on the outer periphery of the valve cap 31 positioned between the base 13 and a flange portion 31C provided around the edge at the other end of the valve cap 31. Such a configuration allows the spring 5 to be applied to a sprinkler head employing a glass bulb as the heat-sensitive disassembling unit.

While the embodiment illustrated in FIGS. 1 to 7 concerns an upward sprinkler head in which the deflector 2 is oriented upward, the spring 5 is also applicable to a downward sprinkler head or a sidewall sprinkler head.

In FIGS. 4 and 6, the spring 5 is fitted from a side nearer to the lever 43 toward the bar 42. Alternatively, the spring 5 may be fitted from the opposite side. The spring 5 prevents the components forming the heat-sensitive disassembling unit 4 from being caught by the deflector 2 when receiving the flow of water discharged from the nozzle 12 at the activation of the sprinkler head. That is, the position where the spring 5 is to be provided may be selected appropriately in accordance with the shape of the deflector 2.

For example, in a case of a sidewall sprinkler head, an assist deflector may be provided near the deflector provided on the extension of the nozzle. In such a case, the spring 5 may be urged in a direction away from the assist deflector.

Figure 8:
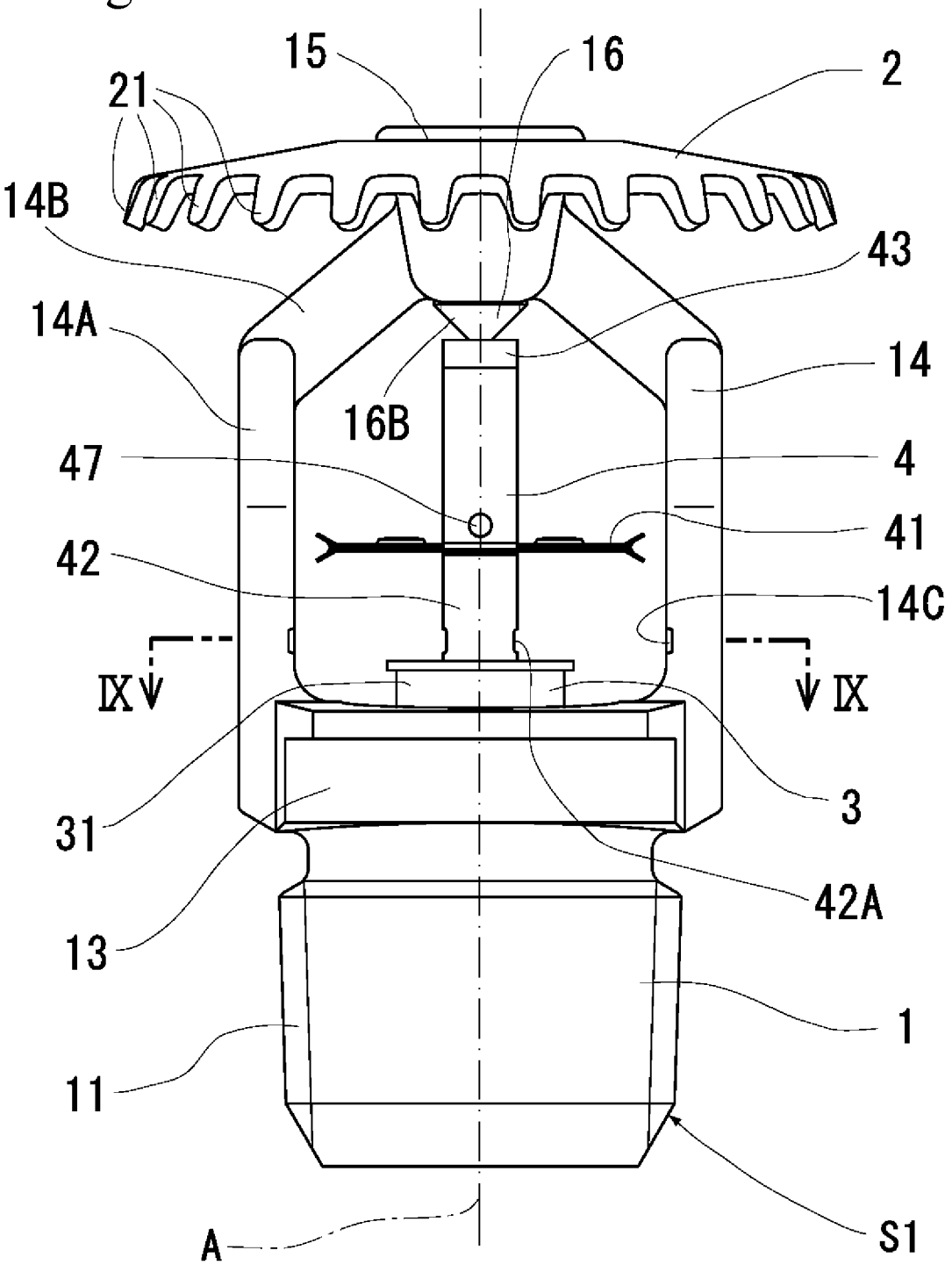
FIG. 8 is a front view of a sprinkler head according to a modification in which frames and a bar have respective grooves for anchoring a spring, which is yet to be fitted thereto.
Figure 9:
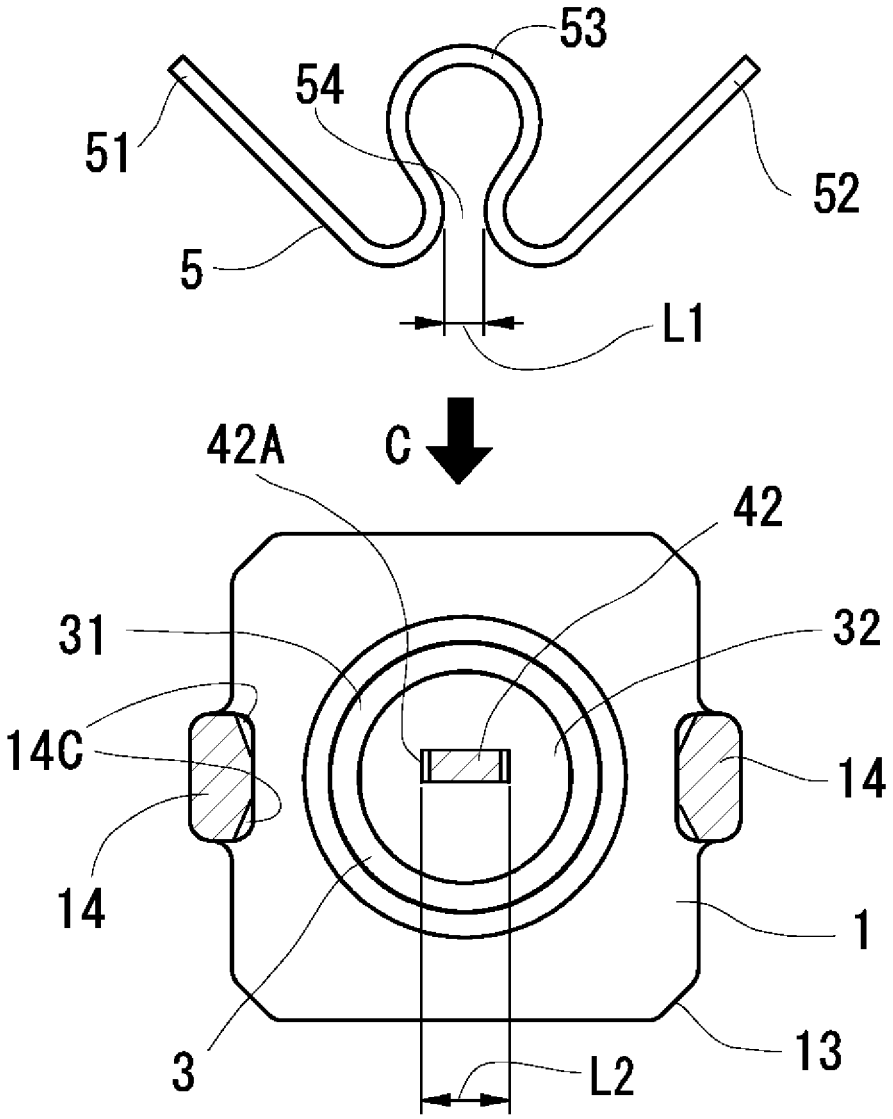
FIG. 9 is a sectional view taken along line IX-IX illustrated in FIG. 8, with the spring being yet to be fitted.

In another modification illustrated in FIGS. 8 and 9, the frames 14 have grooves 14C engaging with the spring 5. The grooves 14C are provided in respective surfaces of the pair of frames 14 that face each other. Likewise, the bar 42 has a groove 42A. In such a configuration, the displacement of the spring 5 in the vertical direction is suppressed, whereby the spring 5 can be stably set in a predetermined position.

REFERENCE SIGNS LIST

S1 sprinkler head
1 body
2 deflector
3 valve
4 heat-sensitive disassembling unit
5 spring
12 nozzle
13 base
14 frame
15 boss
16 impression screw
21 tooth
31 valve cap
32 disc
33 disc spring
41 link
42 bar
43 lever
51, 52 end of spring
53 bent portion
54 open part

The invention claimed is:

1. A sprinkler head comprising:

a body having a nozzle to be connected to a water supply pipe, the nozzle being provided inside the body;

a valve that closes the nozzle in normal times;

a pair of frames extending from the body in a direction of water discharge from the nozzle;

a deflector provided at a distal end of a coupled part where distal ends of the pair of frames are coupled to each other on a center axis of the nozzle; and a heat-sensitive disassembling unit provided between the valve and the deflector, the heat-sensitive disassembling unit having a bar, a spring having a bent portion with an open part between two ends, the two ends engaged with the pair of frames respectively, the bent portion surrounding the bar except the open part, and a width of the open part being narrower than a width of the bar so as to prevent the bar from being caught by the deflector when actuated.

2. The sprinkler head according to claim 1, wherein the heat-sensitive disassembling unit includes a link formed of a plurality of thin plates joined to one another with a low-melting-point alloy, the heat-sensitive disassembling unit further including a bar and a lever that are engaged with the link.

3. The sprinkler head according to claim 1, wherein the heat-sensitive disassembling unit is a glass bulb.

4. The sprinkler head according to claim 1, wherein the valve has a bottomed cylindrical shape, wherein a bottom side of the valve is positioned in the nozzle, wherein one end of the heat-sensitive disassembling unit is engaged with an open side of the valve, and wherein the open side of the valve is fitted in the bent portion of the spring.

5. The sprinkler head according to claim 1, wherein the frames have grooves that engage with the spring.

6. The sprinkler head according to claim 1, wherein the bar has a groove that engages with the spring.

7. The sprinkler head according to claim 1, wherein a gap of the open part is widened when forces are applied to the two ends in such a manner as to move the two ends toward each other, and the spring elastically deforms.

8. The sprinkler head according to claim 1, wherein the spring is located above and spaced away from the valve.

9. The sprinkler head according to claim 1, wherein the bent portion and the two ends are on a same plane perpendicular to the center axis of the nozzle.

10. The sprinkler head according to claim 1, wherein the two ends are engaged with the pair of frames from a same side where the open part is located.

11. The sprinkler head according to claim 1, wherein an end of the bar is engaged with the valve.

* * * * *